US006231419B1

(12) United States Patent
Lee

(10) Patent No.: US 6,231,419 B1
(45) Date of Patent: May 15, 2001

(54) PEN-CAP PROPELLER TOY

(76) Inventor: Nam Hoon Lee, 171 Muldoon Rd., #107, Anchorage, AK (US) 99504

( * ) Notice: Subject to any disclaimer, the term of this patent is extended or adjusted under 35 U.S.C. 154(b) by 0 days.

(21) Appl. No.: 09/493,975

(22) Filed: Jan. 28, 2000

(51) Int. Cl.[7] ..... A63H 33/40

(52) U.S. Cl. ..... 446/217; 446/218; D19/54; D19/55; D19/56

(58) Field of Search ..... 446/217, 218; D19/54, 56, 55

(56) References Cited

U.S. PATENT DOCUMENTS

| | | | | |
|---|---|---|---|---|
| 396,295 | * | 1/1889 | Schofield | 446/217 |
| 571,449 | * | 11/1896 | Laube | 446/217 |
| 1,769,784 | * | 7/1930 | Hoppe | 446/217 |
| 1,782,555 | * | 11/1930 | Weinstein | 446/217 |
| 2,373,499 | * | 4/1945 | Passanante | 446/217 |
| 3,818,629 | * | 6/1974 | Davidson | 446/217 |
| 4,582,497 | * | 4/1986 | Lyons | 446/217 |

* cited by examiner

*Primary Examiner*—Jacob K. Ackun, Jr.
*Assistant Examiner*—Bera B. Mill
(74) *Attorney, Agent, or Firm*—Michael J. Tavella

(57) ABSTRACT

A pen cap that has a propeller attached to the shirt clip found on many pens. The propeller is designed to rotate about a fixed shaft as an amusing diversion for small children or bored executives. An alternative design has a hinge mounted at the top of the clip that allows the clip and propeller to rotate 90 degrees. This increases the range of amusement for the device.

9 Claims, 5 Drawing Sheets

PEN-CAP PROPELLER TOY

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to propeller toys and particularly to propeller toys attached to pen caps.

2. Description of Related Art

Propeller toys have been around for many years. Pinwheels, toy airplanes and other such toys all use some type of propeller as part of their novelty. Although many such devices exist, they are usually limited to toys. Examples of such toys are found in U.S. Pat. Nos. 390,655, 3,140,954, 3,252,241, 3,818,629, 4,120,561, and 5,368,515,

SUMMARY OF THE INVENTION

The present invention seeks to add new utility to simple toys. The invention is a pen cap that has a propeller attached to the clip found on many pens. The propeller is designed to rotate about a fixed shaft as an amusing diversion for small children or bored executives. An alternative design has a hinge mounted at the top of the clip that allows the clip and propeller to rotate 90 degrees. This increases the range of amusement for the device.

DETAILED DESCRIPTION OF THE INVENTION

Figure 1A:
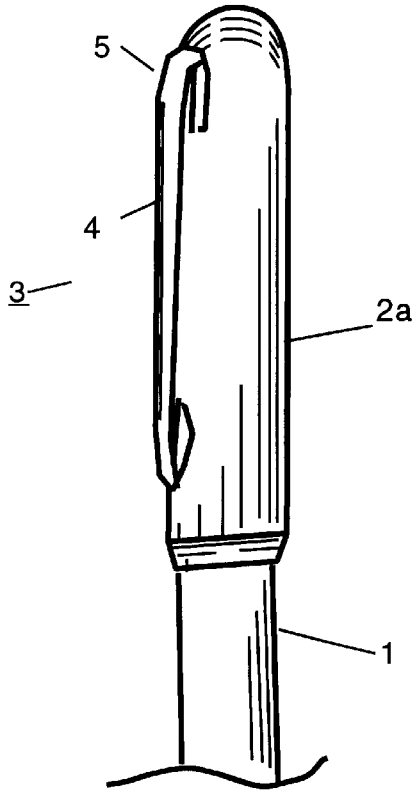
Figure 1a Prior Art
FIG. 1*a* is a perspective view of a pen with a removable cap as prior art.
Figure 1B:
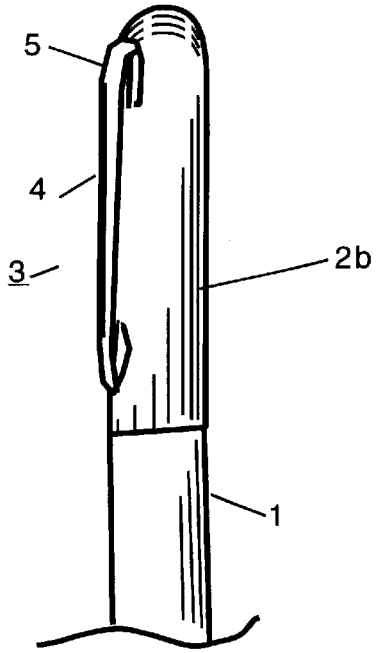
Figure 1b Prior Art
FIG. 1*b* is a perspective view of a pen with a fixed cap as prior art.

Referring now to FIGS. l*a* and l*b*, a typical pen cap 2 is shown. Today, pens can have removable caps 2*a* or attached caps 2*b*. FIGS. l*a* and l*b* show the removable and fixed caps on a portion of a pen body 1. Whether the cap 2 is removable or not, is not important to the operation of the invention. The invention works on either style pen cap 2*a* or 2*b*. Most pen caps 2 have a spring clip 3 that is used to hold the pen 1 in a pocket. This clip 3 is usually attached to the cap 2 has a thin shaft 4 and an ovular end 5. The instant invention is attached to the clip 3 as discussed below.

Figure 2:
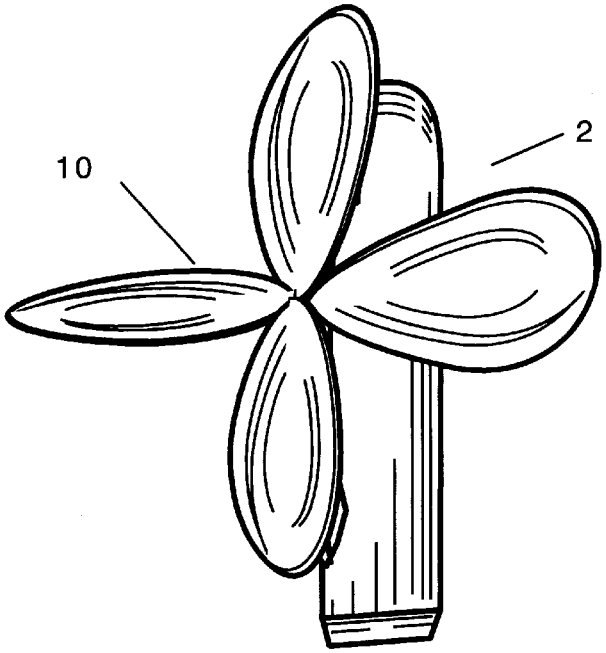
FIG. 2 is a perspective view of the invention.
Figure 3:
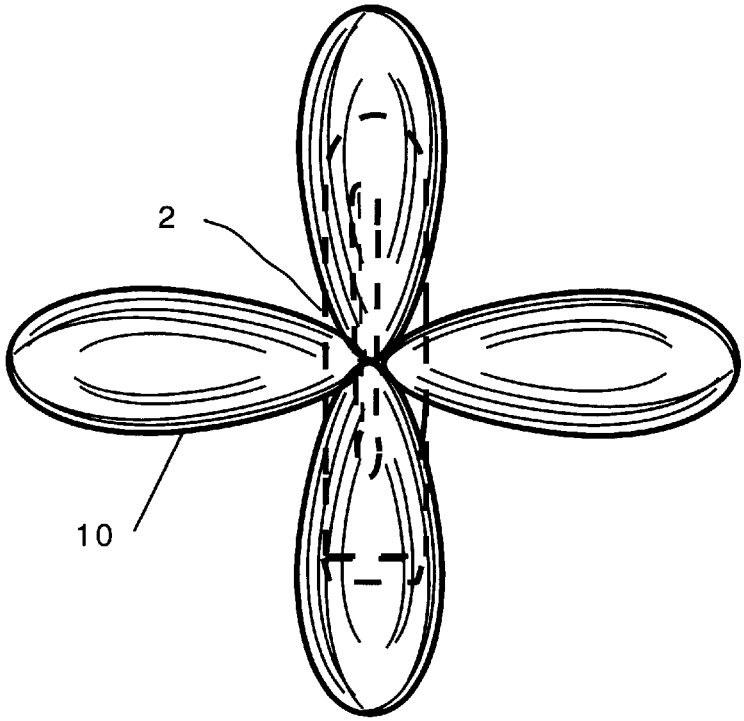
FIG. 3 is a front view of the invention.
Figure 4:
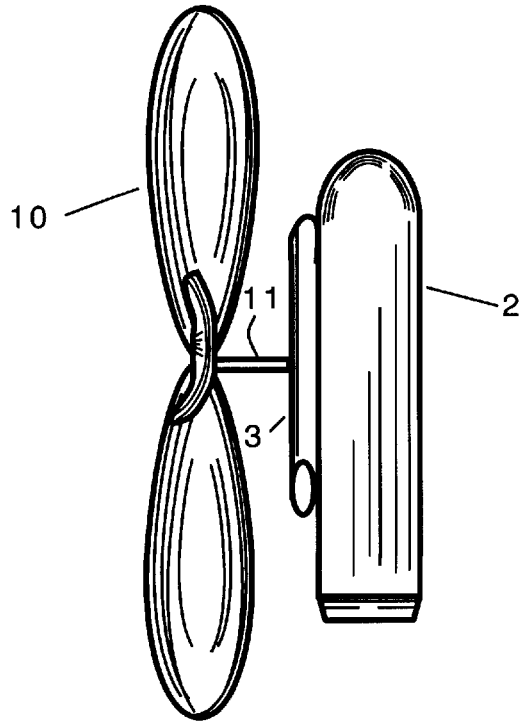
FIG. 4 is a side view of one embodiment of the invention.
Figure 5:
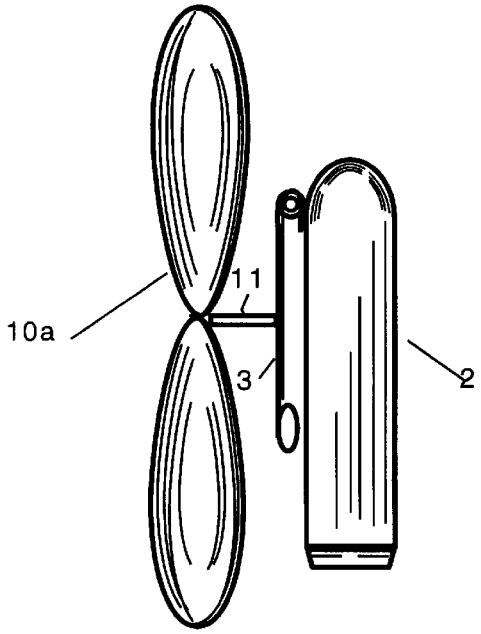
FIG. 5 is a side view of a second embodiment of the invention made with two blades.
Figure 6:
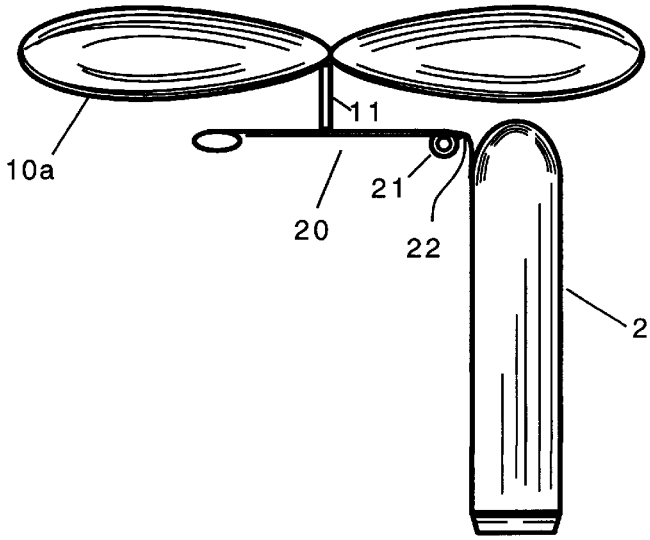
FIG. 6 is a side view of the second embodiment of the invention, made with two blades, in a rotated position.
Figure 8:
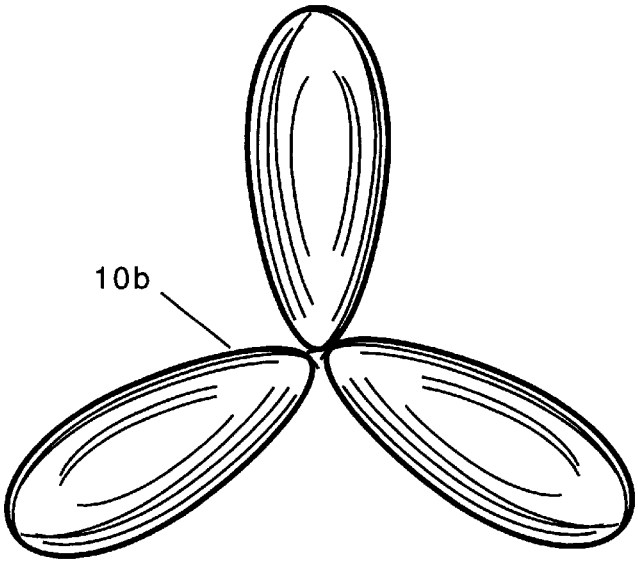
FIG. 8 shows a front view of the propeller with three blades.
Figure 9:
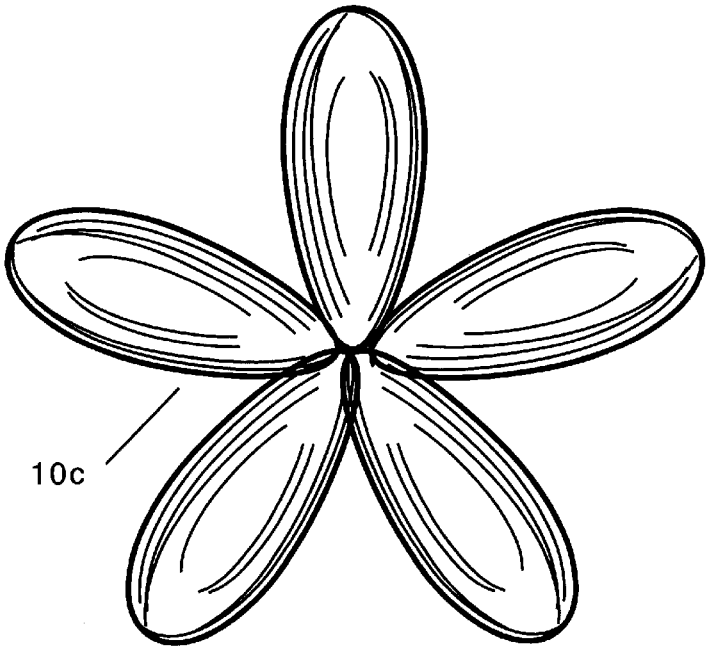
FIG. 9 is a front view of the propeller with five blades.

Referring now to FIGS. 2–4 the first embodiment of the instant invention is shown. In this embodiment, a propeller blade 10 is attached to a shaft 11 that is secured to the clip 3. FIG. 2 shows a perspective view of the first embodiment. This view shows a propeller 10 with four blades. Of course, any number of blades may be used. Four blades are preferred because they produce and enhanced visual effect while the four-bladed propeller 10 is spinning. Two, three or five blades may also be used if desired. Two bladed propellers 10*a* are shown in FIGS. 5 and 6. A three-bladed propeller 10*b* is shown in FIG. 8 and a five-bladed propeller 10*c* is shown in FIG. 9. FIG. 3 shows a front view of the first embodiment with four blades. FIG. 4 is a side view of the first embodiment showing the shaft 11, propeller 10, the pen cap 2 and clip 3.

Figure 7:
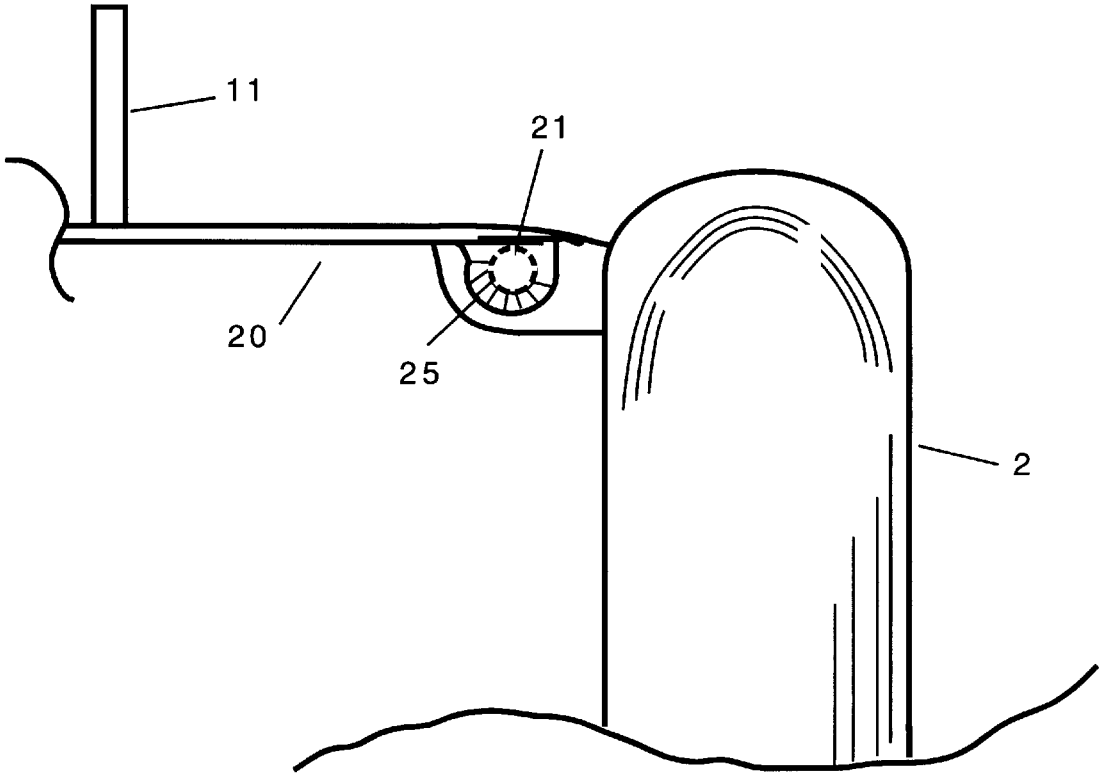
FIG. 7 is an enlarged detail view of a portion of FIG. 6 showing details of the rotating hinge.

FIGS. 5 and 6 show a second embodiment of the invention. In this embodiment, the clip 20 has a hinge 21 formed at the top end 22 of the clip 20 as shown. This hinge 21 allows the clip 20 to rotate 90 degrees as shown in FIG. 6. Locking detents 25 are provided on the hinge 21, as shown in FIG. 7, to lock the clip 20 in either position. These detents 25 are small indentations that the clip 20 locks into when placed in the rotated position of FIG. 7.

FIG. 8 shows the three bladed propeller 10*b*. FIG. 9 shows the five bladed propeller 10*c*. Any of the propellers shown can be used with either embodiment.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A propeller toy comprising:

a) a pen cap;

b) a spring clip, having a hinge means, rotatably attached thereto, and being rotatably attached to said pen cap at said hinge means;

c) a shaft, rotatably attached to said spring clip; and d) a propeller, rotatably attached to said shaft.

2. The propeller toy of claim 1 wherein the propeller has two blades.

3. The propeller toy of claim 1 wherein the propeller has three blades.

4. The propeller toy of claim 1 wherein the propeller has four blades.

5. The propeller toy of claim 1 wherein the propeller has five blades.

6. The propeller toy of claim 1 wherein said shaft extends perpendicularly from said spring clip.

7. The propeller toy of claim 1 wherein said spring clip may be rotated about said hinge means from a first position, substantially parallel to said pen cap, to a second positon, substantially perpendicular to said pen cap.

8. The propeller toy of claim 7 wherein said hinge means futher comprise means for locking the spring clip in said first position; and means for locking said pen cap in said second position.

9. The propeller toy of claim 8 wherein the means for locking the spring clip in said first postion and the means for locking said pen cap in said second position comprise a detent, formed in said hinge means, to frictionally engage said spring clip when said spring clip is in the second position.

* * * * *